US009968170B2

(12) United States Patent
Morszeck

(10) Patent No.: US 9,968,170 B2
(45) Date of Patent: May 15, 2018

(54) SUITCASE, ESPECIALLY A PILOT SUITCASE

(71) Applicant: Rimowa GmbH, Cologne (DE)

(72) Inventor: Dieter Morszeck, Cologne (DE)

(73) Assignee: Rimowa GmbH, Cologne (DE)

( * ) Notice: Subject to any disclaimer, the term of this patent is extended or adjusted under 35 U.S.C. 154(b) by 73 days.

(21) Appl. No.: 14/782,348

(22) PCT Filed: Feb. 20, 2014

(86) PCT No.: PCT/EP2014/053342
§ 371 (c)(1),
(2) Date: Oct. 5, 2015

(87) PCT Pub. No.: WO2014/166665
PCT Pub. Date: Oct. 16, 2014

(65) Prior Publication Data

US 2016/0051022 A1 Feb. 25, 2016

(30) Foreign Application Priority Data

Apr. 9, 2013 (DE) ..... 20 2013 003 245 U

(51) Int. Cl.
*A45C 5/03* (2006.01)
*A45C 13/00* (2006.01)
(Continued)

(52) U.S. Cl.
CPC ..... *A45C 13/005* (2013.01); *A45C 5/02* (2013.01); *A45C 5/03* (2013.01); *A45C 5/14* (2013.01);
(Continued)

(58) Field of Classification Search
CPC ..... A45C 113/007; A45C 13/262; A45C 5/03; A45C 2005/0037; A45C 2013/267;
(Continued)

(56) References Cited

U.S. PATENT DOCUMENTS 1,600,909 A * 9/1926 Seward ..... A45C 11/02 190/113
1,718,134 A 6/1929 Gallion
(Continued)

FOREIGN PATENT DOCUMENTS

CN 2246942 Y 2/1997
CN 1372061 A 10/2002
(Continued)

OTHER PUBLICATIONS

Singapore Written Opinion dated Feb. 13, 2017, in connection with corresponding SG Application No. 11201508240X (6 pgs.).
(Continued)

*Primary Examiner* — Sue A Weaver
(74) *Attorney, Agent, or Firm* — Maier & Maier, PLLC

(57) ABSTRACT

A suitcase made from hard shell material, preferably a pilot suitcase, including a lower suitcase portion which is open at the top, with a front panel, a rear panel and two side end panels, and a bottom panel, and a hinged lid for closing, wherein a telescopic handle can be pulled out in an upwards direction is arranged on the rear panel of the lower suitcase portion for pulling or pushing the suitcase, the lid having a narrow stationary lid element which extends along the entire length of the lower suitcase portion along the rear panel and has an opening in the middle of the length, through which opening the telescopic handle can be pulled out, and, next to the opening for the telescopic handle, the lid having a hinge which connects the stationary lid element to a fold-down wide lid element.

11 Claims, 4 Drawing Sheets

(51) Int. Cl.

| | |
|---|---|
| ***A45C 5/02*** | (2006.01) |
| ***A45C 5/14*** | (2006.01) |
| ***A45C 13/26*** | (2006.01) |
| ***A45C 15/06*** | (2006.01) |
| *A45C 13/04* | (2006.01) |
| *A45C 13/34* | (2006.01) |

(52) U.S. Cl.
CPC ..... *A45C 13/262* (2013.01); *A45C 15/06* (2013.01); *A45C 13/04* (2013.01); *A45C 13/34* (2013.01); *A45C 2005/037* (2013.01); *A45C 2013/267* (2013.01)

(58) Field of Classification Search
CPC ..... A45C 5/146; A45C 5/06; A45C 13/007; A45C 2005/037; A45C 5/145; A45C 7/0018
USPC ..... 190/4, 113, 115, 122, 114, 119; 150/112, 150/122; 292/48
See application file for complete search history.

(56) References Cited

U.S. PATENT DOCUMENTS

| | | | | |
|---|---|---|---|---|
| 2,561,888 | A * | 7/1951 | Ruge | A45C 13/03 190/113 |
| 3,029,915 | A * | 4/1962 | Axtell | A45C 5/00 190/115 |
| 4,529,069 | A | 7/1985 | March | |
| 5,011,198 | A * | 4/1991 | Gruenberg | G06F 1/1616 190/115 |
| 6,779,681 | B2 | 8/2004 | Doerfler et al. | |
| 7,437,899 | B1 * | 10/2008 | Ma | E05B 37/0034 292/36 |
| 7,748,508 | B2 * | 7/2010 | Lee | A45C 5/14 190/115 |
| 8,277,073 | B2 | 10/2012 | Wells | |
| 2005/0218033 | A1 * | 10/2005 | Curtis | A45D 27/22 206/581 |
| 2008/0000741 | A1 | 1/2008 | Ullrich | |
| 2008/0136133 | A1 | 6/2008 | Takahashi | |
| 2010/0200581 | A1 | 8/2010 | Maltz | |

FOREIGN PATENT DOCUMENTS

| | | | |
|---|---|---|---|
| DE | 159315 | | 6/1929 |
| DE | 20000457 | U1 | 6/2001 |
| DE | 200 00 457 | U1 | 12/2001 |
| DE | 102008026571 | A1 | 12/2009 |
| DE | 10 2011 011 908 | A1 | 8/2012 |
| DE | 102011011908 | A1 | 8/2012 |
| EP | 0836815 | A2 | 4/1998 |
| GB | 2447405 | B | 4/2009 |
| JP | S5386206 | U | 7/1978 |
| JP | 2002-325616 | A | 11/2002 |
| JP | 2002325616 | A | 11/2002 |
| JP | 2007524490 | A | 8/2007 |
| JP | 2008538525 | A | 10/2008 |
| JP | 2010279633 | A | 12/2010 |
| WO | 2005/117637 | A1 | 12/2005 |

OTHER PUBLICATIONS

International Search Reporting of corresponding PCT/EP2014/053342 dated Apr. 23, 2014; 6pgs.
Chinese Office Action dated Feb. 4, 2017, in connection with corresponding CN Application No. 201480019949.4 (6 pgs.).
Japanese Office Action dated Aug. 29, 2017, in connection with corresponding JP Application No. 2016-506816 (6 pgs.).

* cited by examiner

SUITCASE, ESPECIALLY A PILOT SUITCASE

The invention relates to a suitcase, especially to a pilot suitcase, as defined in the precharacterizing part of claim 1.

Pilot suitcases of this kind are known from EP1475008A, said suitcases having a lower suitcase portion which is open at the top and has a front panel, a rear panel and two side end panels, as well as a bottom panel, and having a hinged lid for closing the lower suitcase portion, wherein a telescopic handle which is secured inside the suitcase and can be pulled out in an upwards direction is arranged on the rear panel of the lower suitcase portion for pulling the suitcase.

With pilot suitcases, it is desired that it is possible to open and close the suitcase single-handedly. It is a drawback of known pilot suitcases that they either do not allow a single-handed use or that such use is very troublesome, and that the lid when tilted open requires too much space in the constricted space of an airplane. Moreover, the lid element tilted open can cause the suitcase to fall over if the same is not loaded with sufficient weight.

It is an object of the invention to provide a suitcase, especially a pilot suitcase, which allows a single-handed use, can be opened in a space-saving manner and is highly stable against tipping over.

The object is achieved with the features of claim 1.

The invention advantageously provides that the lid has a narrow stationary lid element that extends over the entire width of the lower suitcase portion along the rear panel and has an opening in the middle of the width, through which the telescopic handle can be pulled out, and that, adjacent to the opening for the telescopic handle, the lid has a hinge that connects the stationary lid element with a hinged wide lid element.

Such a division of the lid into a narrow stationary lid element through which the telescopic handle can be pulled out, and a wide hinged lid element makes it possible to open the lid in an advantageous manner, such that it can be moved into a stable open position in which the movable lid element does not or only slightly protrude beyond the rear panel of the suitcase. Therefore, the suitcase can be opened single-handedly, with the lid being retained in the open position only due to gravity, in which position the pilot suitcase cannot fall over either.

Owing to the fact that the movable lid element does not or only slightly protrude beyond the vertical rear panel plane, when in the open state, the space required in the open state of the suitcase is also reduced which is important, for instance, when the pilot suitcase is placed beside a pilot's seat and documents in the suitcase must be accessible to the pilot in a simple manner during flight.

A limiter means may limit de maximum opening angle of the movable lid element such that the lid element does not protrude beyond the rear panel in the open state.

Such a limiter means, e.g. a stop, enhances the stability of the hinged lid element in its open position and prevents an overstretching of the hinge that connects the stationary lid element and the hinged lid element.

The hinge substantially extends over the entire width of the suitcase. Preferably, the hinge is a single-axis hinge.

A lighting means, preferably a light guide LED module, is arranged under the stationary lid element.

The lighting means may be adapted to be activated when the movable lid element is opened, preferably in dependence on the activation state of an ambient light sensor. As an alternative, a switch may be provided with which the lighting can be switched on at least for a predetermined time, e.g. 60 s.

At least two rollers, preferably four castors, are integrated in the bottom panel.

The castors are rollers whose vertical pivot axis is spaced horizontally from the horizontal roller axis. The vertical pivot axis is arranged very close to the corners of the bottom panel, the distance preferably being less than 25 mm to the side end panels or the front or the rear panel.

If four castors are provided, the suitcase can be swiveled about an optional vertical axis in a simple manner.

Preferably, an arresting means is provided on the rear panel.

The arresting means serves to keep the suitcase from rolling away during a plane's climb or descent. The arresting means is formed by a pivotable lever, for example, which is supported on the floor and thereby prevents the suitcase from rolling away.

On the top edge, the lower suitcase portion has a frame element cooperating with the movable lid element.

A frame element o the top edge of the lower suitcase portion provides the suitcase with a high torsional rigidity and thereby increases the endurance of the suitcase.

The frame element cooperating with the lid element may receive locking means, e.g. lock mechanisms, with a lock mechanism being preferred that can be closed or opened by a pressing operation.

For this purpose, a push button is provided, for example, which, when actuated, may release two locking levers so that the movable lid element can be opened. To close the suitcase, the locking levers may be pushed into a position flush with the front panel, so that a single-handed actuation is ensured both when closing and when opening the suitcase. In addition, the frame element may accommodate a combination lock.

The frame element may be made of metal.

The suitcase is essentially made of a hard plastic material, preferably polycarbonate, or of a high-strength aluminum alloy.

The following is a detailed description of an embodiment of the invention with reference to the drawings.

Figure 1:
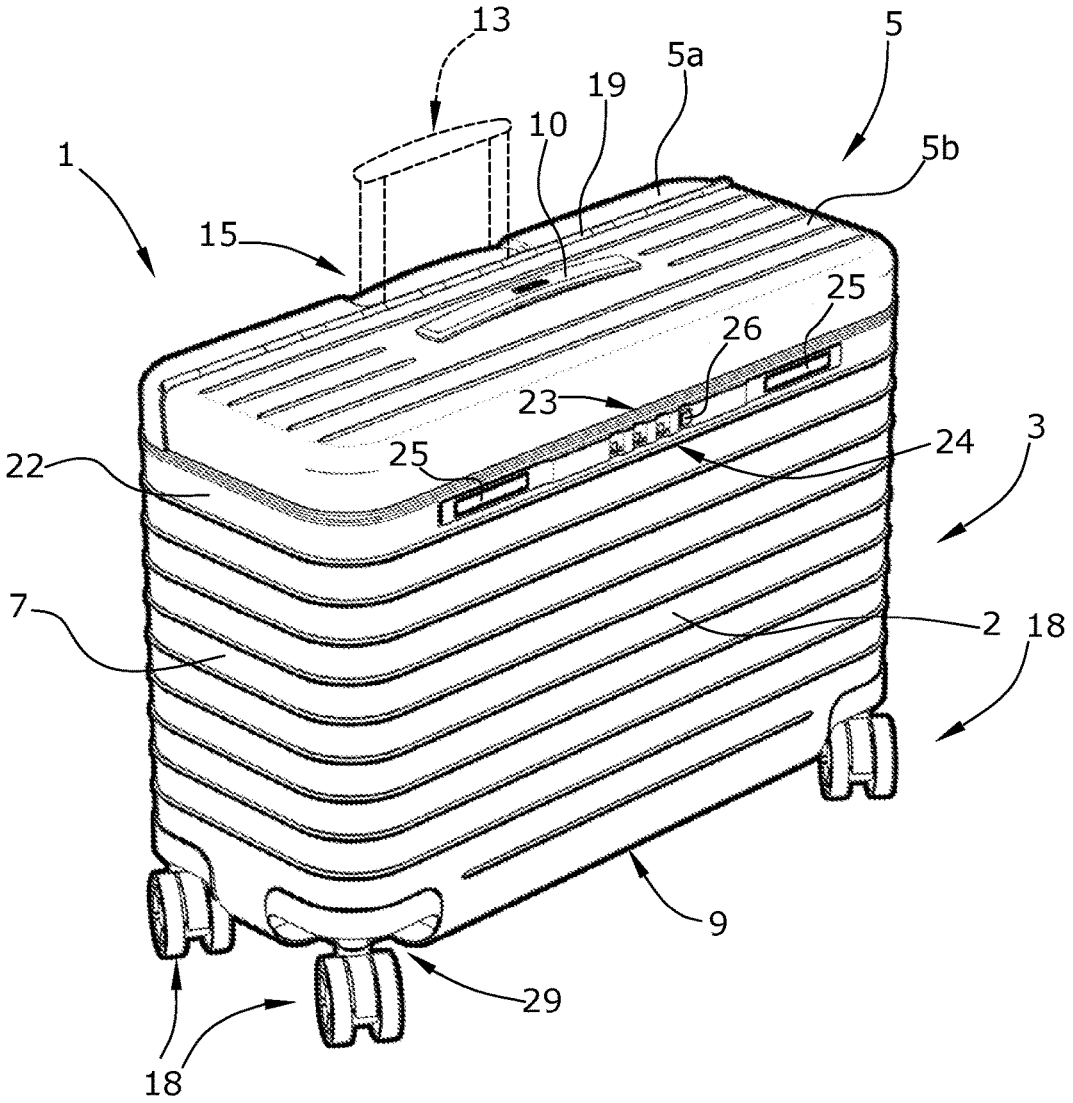
FIG. 1 is a perspective front view of the pilot suitcase.
Figure 2:
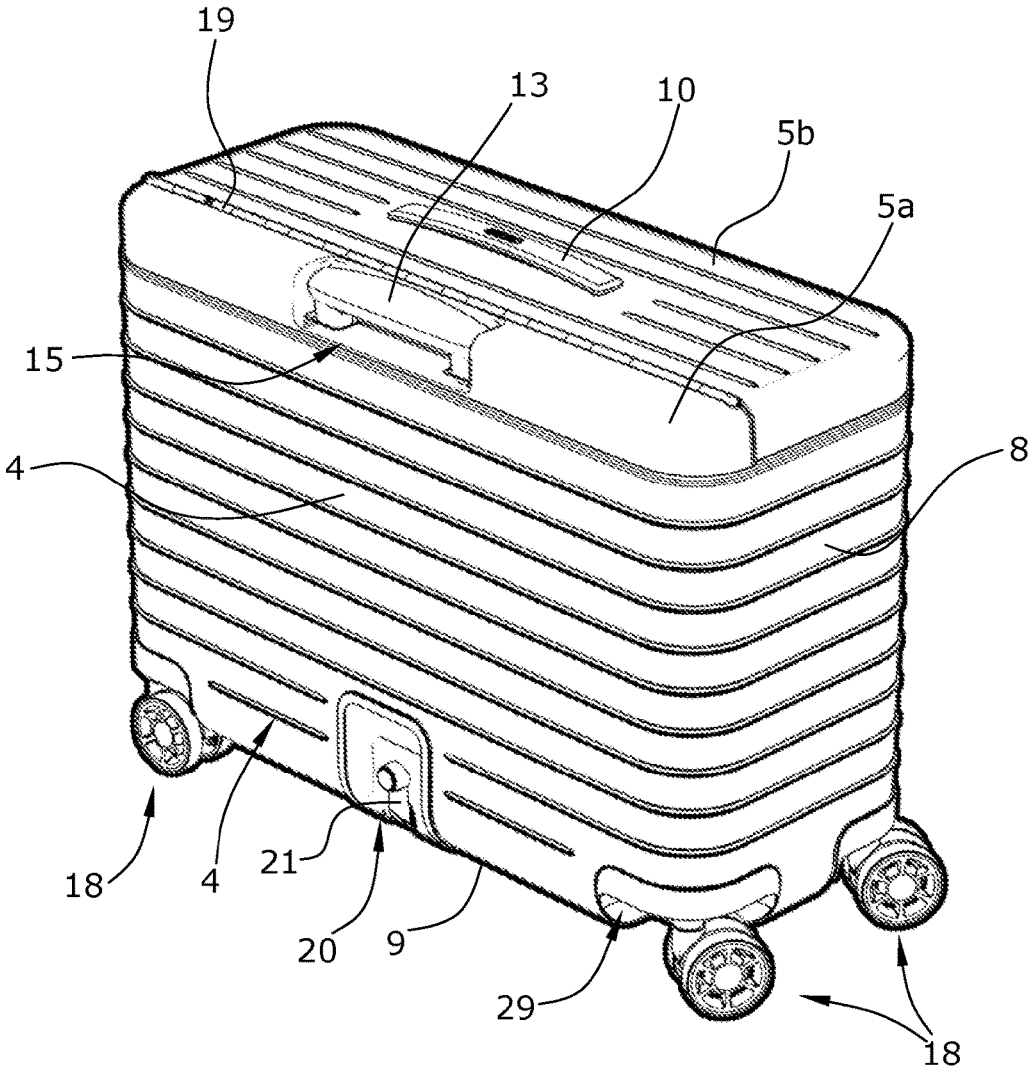
FIG. 2 is a perspective rear view of the pilot suitcase.

FIG. 1 is a perspective view of a suitcase 1 with a lower suitcase portion 3 open at the top. The lower suitcase portion 3 has a front panel 2, a rear panel 4 and two side end panels 7, 8, as well as a bottom panel 9. A lid 5 for closing the lower suitcase portion 3 open at the top is formed by a stationary lid element 5*a* and a movable hinged lid element 5*b*. To open the movable lid element 5*b*, the top surface of the same is provided with a handle 10 which, in the closed state of the suitcase 1, can also be used to carry the pilot suitcase. A telescopic handle 13 for pulling the suitcase 1, mounted on the inner side of the lower suitcase portion 3, protrudes through an opening 15 in the stationary lid element 5*a*. In a position of non-use, the telescopic handle 13 is sunk in the recess or the opening 15 such that it does not protrude upwards with respect to the lid element 5*a*.

The lid elements 5*a*, 5*b* are connected through a hinge 19 that extends as a single axis hinge over substantially the entire width of the pilot suitcase. Lock mechanisms are arranged at the upper edge of the lower suitcase portion 3 open at the top, the mechanisms cooperating with the movable lid element 5*b*. By actuating a push button 26, the two lever lock elements 25 can be opened single-handedly, the locking levers 25 folding out from the plane of the front panel 2, thereby releasing locking pins of the lid element 5*b* which are not illustrated herein. In addition, the lock mechanism may comprise a combination lock 23. To lock the lid element 5*b* in the closed position, the locking levers 25 can be pushed single-handedly into their locking position one after the other, the levers being substantially flush with the front panel 2 in this position.

The lid 5 may also comprise a spring means or a spring damping means, by which the movable lid element 5*b* can be moved into the open position in a self-acting manner when the push button 26 is actuated.

Thus, a single-handed operation is ensured both for opening and closing the suitcase.

The closing mechanisms 24 are preferably integrated in a frame element 22 of metal that borders and finishes the lower suitcase portion 3 at the top.

Figure 4:
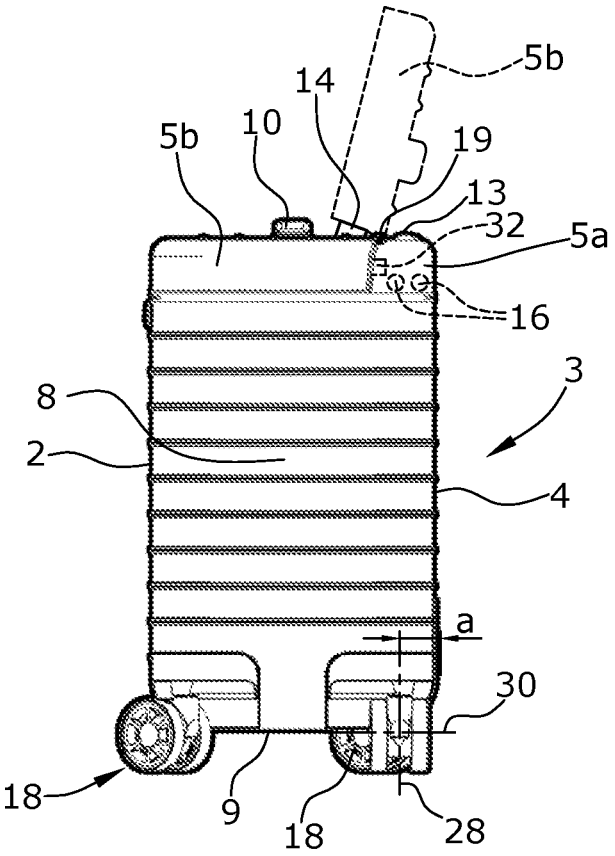
FIG. 4 shows the suitcase with the lid open.

In the open position of the movable lid element 5*b*, illustrated in FIG. 4, the suitcase lid may be moved into a stable pivoted position in which the lid element 5*b* does not protrude rearward beyond the rear panel 4, whereby the suitcase cannot fall over and, moreover, the space required by the suitcase is restricted to the footprint of the suitcase that substantially corresponds to the bottom panel 9.

The lid element 5*b* may also be provided with a limiter means 14 for the maximum opening angle of the lid element 5*b*, which means limits the maximum opening angle of the lid element 5*b* in a stable manner and/or retains the lid element 5*b* in the predetermined open position in a stable manner. Thereby, it is also possible to avoid an unintentional closing of the hinged lid element 5*b*.

A pocket may be provided on the inside of the lid element 5*b* to receive small parts.

The stationary lid element 5*a* may include a lighting means 16 that preferably is equipped with power-saving LEDs and which preferably comprises one or a plurality of light guide LED modules, as schematically illustrated in FIG. 4. The lighting means 16 may be activated by means of a switch, wherein the period of activation may be adjusted to a predetermined or adjustable value.

As an alternative, the lighting means can be activated automatically when the lid element 5*b* is opened. Moreover, an ambient light sensor 32 may in this case prevent the activation of the lighting means if sufficient ambient light is available.

Figure 3:
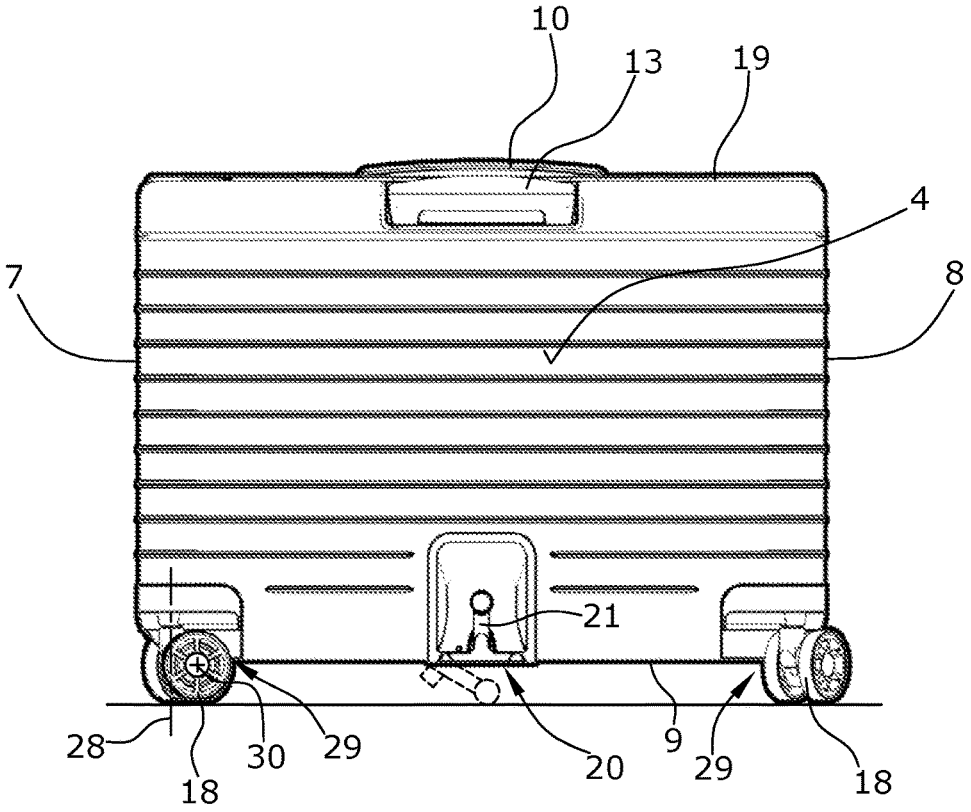
FIG. 3 is another rear view of the suitcase with an arresting means.

The suitcase preferably stands on four castors 18 sunk in recesses 29 in the corners of the bottom panel 9. The vertical axes 28 of the castors 18 preferably have a minimum possible distance a to the panels 2, 4, 7, 8. The distance a should preferably be mm. The horizontal rotation axis 30 of the castors 18 is spaced horizontally from the vertical pivot axis 28, as is best seen in FIG. 3. The castors 18 allow the pilot suitcase to be swiveled in almost any manner about vertical axes.

To prevent the pilot suitcase from rolling away during a climb or a descent of the airplane, an arresting means 20 is provided preferably on the rear panel 4 in the vicinity of the bottom panel 9, the arresting means having a pivot lever 21 that may be moved into a downwardly pivoted position, as is best seen in FIG. 3, in which position the rear castors 18 are slightly lifted, whereby the suitcase is fixed in its standing position.

The invention claimed is:

1. A suitcase of hard shell material, preferably a pilot suitcase, comprising:

a lower suitcase portion which is open at the top, with a front panel, a rear panel and two side end panels, and with a bottom panel, and a hinged lid for closing the lower suitcase portion, wherein a telescopic handle which is secured inside the suitcase and can be pulled out in an upwards direction is arranged on the rear panel of the lower suitcase portion for pulling or pushing the suitcase, wherein the lid has a narrow stationary lid element which extends along the entire width of the lower suitcase portion along the rear panel and has an opening in the middle of the width, through which opening the telescopic handle can be pulled out, and adjacent to the opening for the telescopic handle, the lid has a hinge which connects the stationary lid element to a hinged wide lid element, such that the lid can be moved into a stable open position in which the movable lid element does not protrude or only slightly protrudes beyond the rear panel of the suitcase in such a manner as to enable the suitcase to be open single-handedly, with the lid being retained in the open position only due to gravity, wherein lock mechanisms are provided, with a push button, to enable a single-handed operation when opening the suitcase.

2. The suitcase of claim 1, wherein a limiter means limits the maximum folding angle of the hinged lid element such that the lid element does not protrude beyond the rear panel when in the open state.

3. The suitcase of claim 1, wherein the hinge extends over the entire width of the suitcase.

4. The suitcase of one of claim 1, wherein a lighting means is arranged under the stationary lid element.

5. The suitcase of one of claim 1, wherein at least two rollers are integrated in the bottom panel.

6. The suitcase of one of claim 1, wherein an arresting means is arranged, preferably at the rear panel.

7. The suitcase of one of claim 1, wherein the lower suitcase portion has a frame element at the upper edge, which element cooperates with the movable lid element.

8. The suitcase of claim 7, wherein the frame element receives lock mechanisms cooperating with the movable lid element.

9. The suitcase of claim 7, wherein the frame element is made of metal.

10. The suitcase of claim 4, wherein the lighting means is adapted to be activated when the movable lid element is opened, preferably as a function of an activation state of an ambient light sensor.

11. The suitcase of claim 1, wherein the suitcase is substantially made of polycarbonate or of an aluminum alloy.

* * * * *